United States Patent [19]

Bezborodko

[11] Patent Number: 4,724,638

[45] Date of Patent: Feb. 16, 1988

[54] DECORATIVE WALL SYSTEM

[76] Inventor: Joseph Bezborodko, 5235 Fieldston Rd., Bronx, N.Y. 10471

[21] Appl. No.: 822,905

[22] Filed: Jan. 27, 1986

[51] Int. Cl.[4] ..... B44F 7/00

[52] U.S. Cl. ..... 52/311; 52/509; 52/511

[58] Field of Search ..... 52/311, 312, 314, 506, 52/509, 173 R, 508, 511, 512, 410, 469, 459, 417, 420, 588

[56] References Cited

U.S. PATENT DOCUMENTS

| | | | |
|---|---|---|---|
| 4,063,395 | 12/1977 | Stewart et al. | 52/509 X |
| 4,143,496 | 3/1979 | Destito | 52/173 R |
| 4,158,274 | 6/1979 | Saenz | 52/311 X |
| 4,320,605 | 3/1982 | Carlson et al. | 52/410 X |
| 4,452,022 | 6/1984 | Bezborodko | 52/311 |
| 4,528,783 | 7/1985 | Muir | 52/509 X |

*Primary Examiner*—Carl D. Friedman
*Assistant Examiner*—Richard E. Chilcot, Jr.
*Attorney, Agent, or Firm*—Gottlieb, Rackman & Reisman

[57] ABSTRACT

For use in a modular decorative wall system, a decorative panel structure includes a decorative panel adhesively bonded to a backing panel of rigid expanded polystyrene, the size of the backing panel being greater than that of the decorative panel to provide the backing panel with a marginal region extending beyond at least two opposite side edges of the decorative panel. To mount to the composite panel structure on a wall, the broad heads of a plurality of tacks are first fixed to the wall so that the prongs of the tacks, the lengths of which exceed the thickness of the backing panel, project outwardly from the wall at respective locations bracketing the two opposite side edges of the decorative panel. The composite panel structure is then "hung" on the wall by pushing the marginal regions of the backing panel onto the projecting prongs until the free end regions of the latter have penetrated through the backing panel. Suitable friction or locking washers are then forced onto the free end backing panel to maintain the latter securely in place. Gaps between adjacent decorative panels may be covered by decorative strips adhesively secured to the proximate side edge regions of the adjacent decorative panels.

21 Claims, 17 Drawing Figures

Fig. 3.
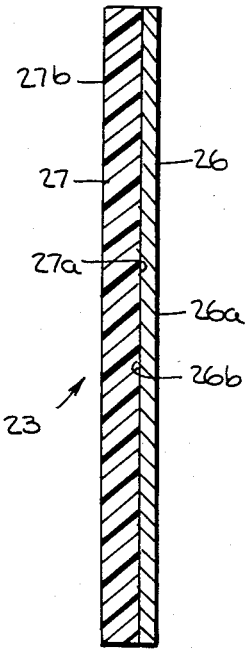
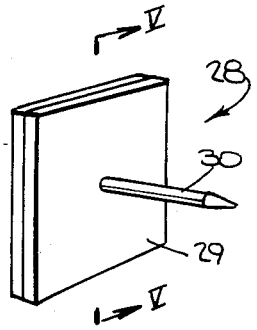
Fig. 4.
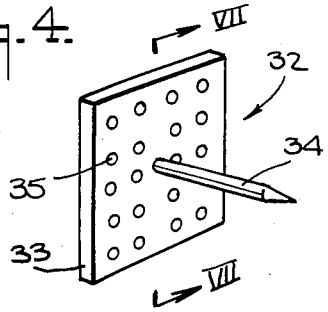
Fig. 6.
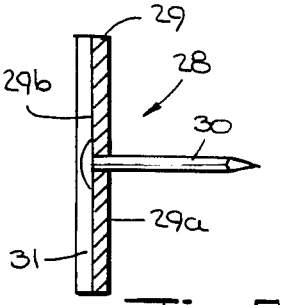
Fig. 5.
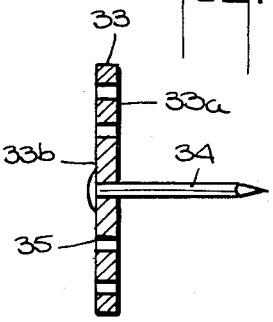
Fig. 7.
Fig. 8.
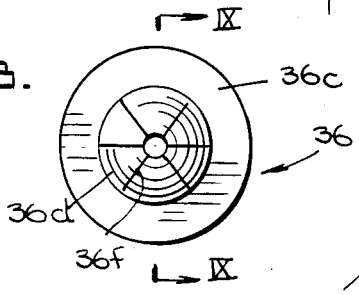
Fig. 10.
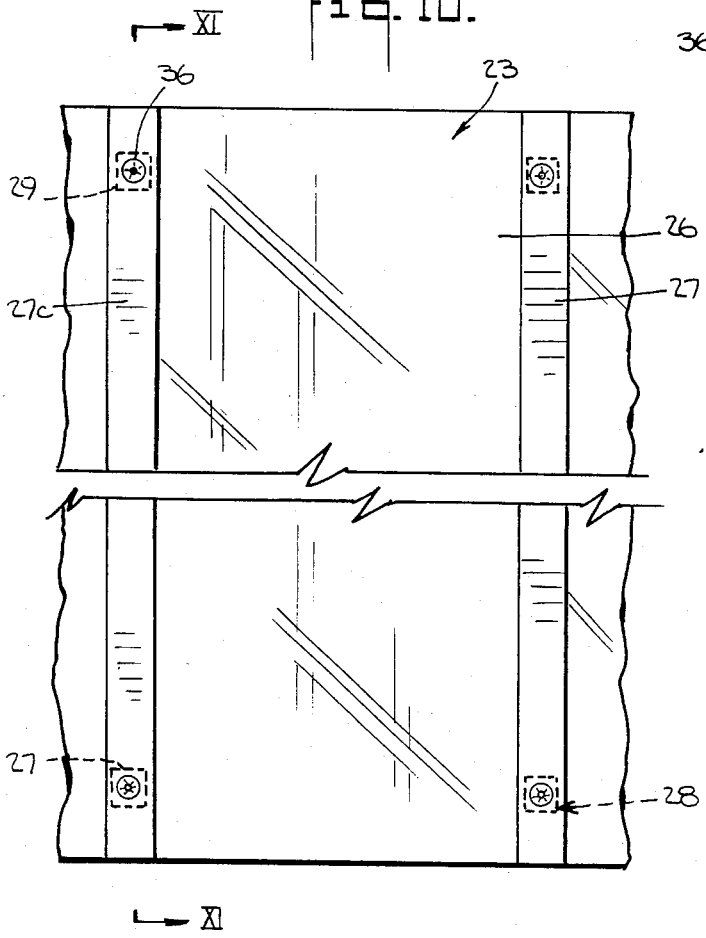
Fig. 9.
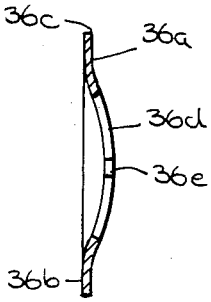
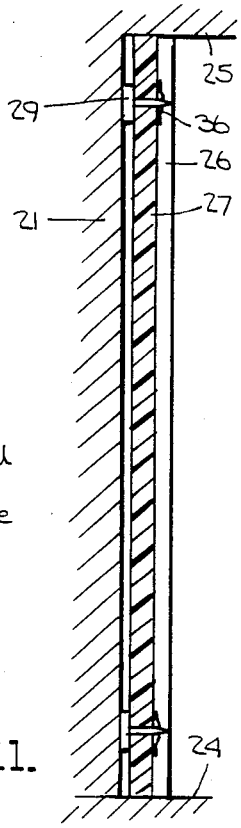
Fig. 11.

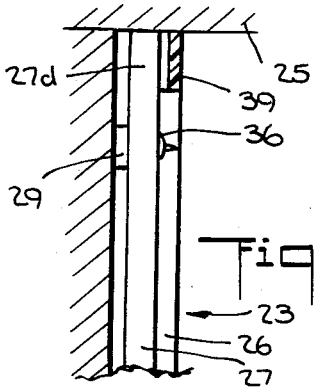
Fig. 14.
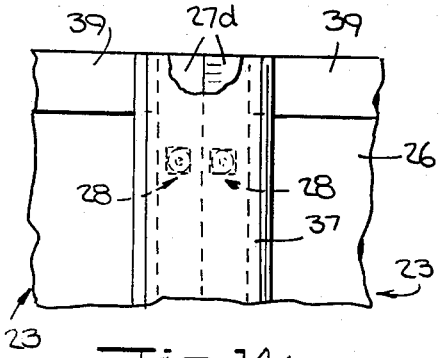
Fig. 14A.
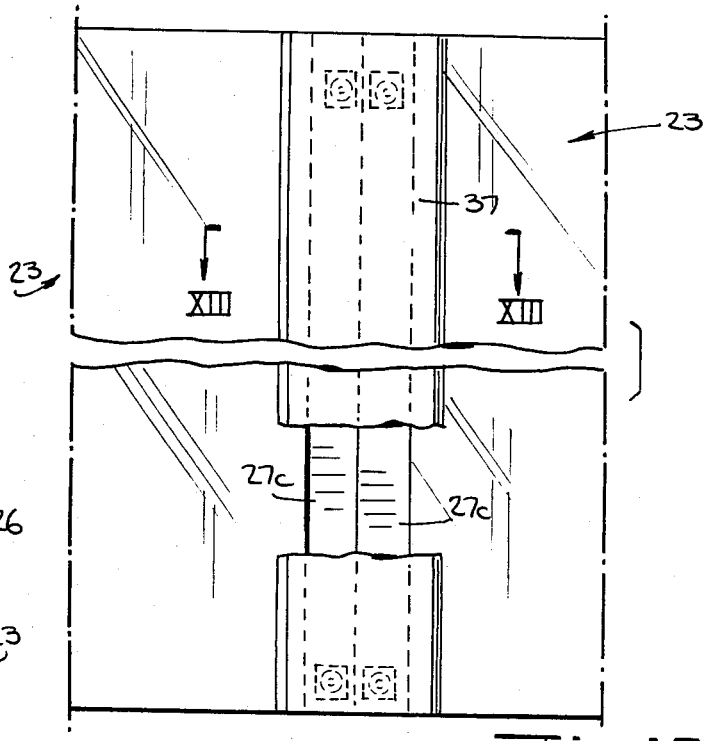
Fig. 12.
Fig. 13.
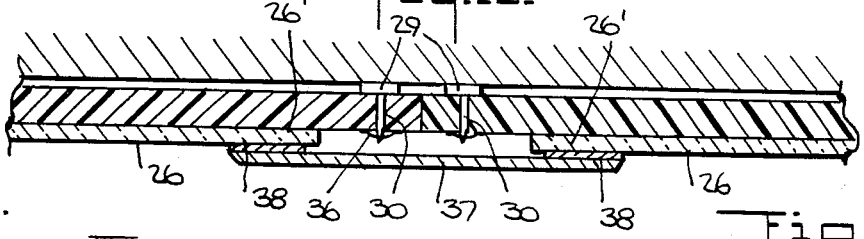
Fig. 15.
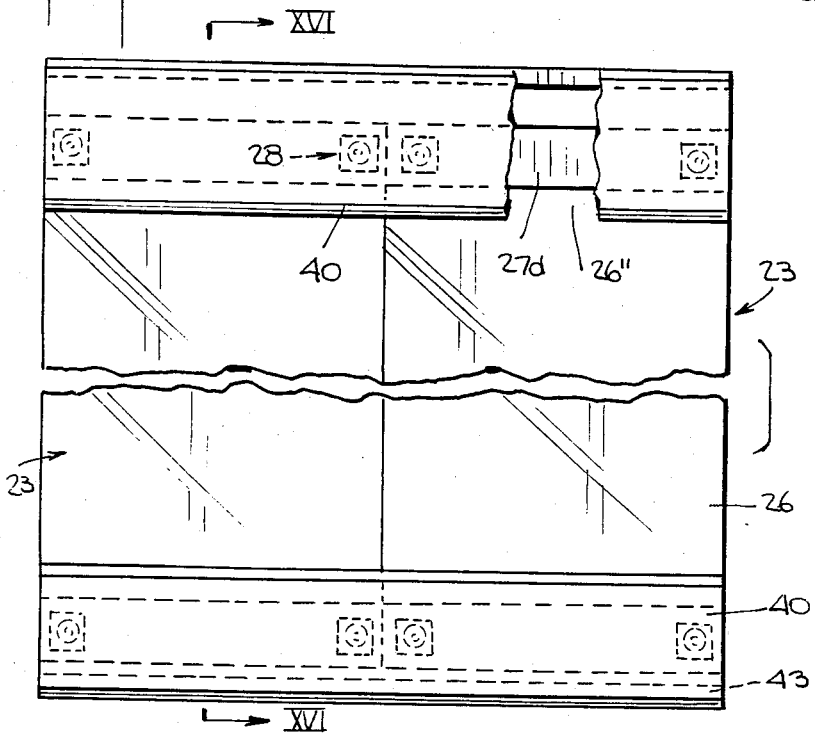
Fig. 16.
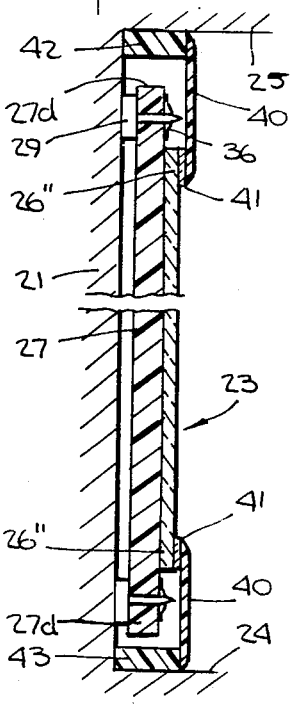

DECORATIVE WALL SYSTEM

This application relates to a decorative wall system for decoratively covering an existing wall structure.

Although, as will become apparent from the following, the principles of the present invention are applicable to a variety of types of decorative wall systems, irrespective of whether the decorative element of the paneling used is made of glass, wood, marble, particle board, plaster board, fabric, or the like, the following description will focus in the first instance on a system of mirror wall panels.

As pointed out in my prior U. S. Pat. No. 4,452,022, in contemporary interior design it is quite fashionable to use mirrors for decorative purposes. Thus, mirrors are frequently used to cover one or more walls of a room for decorative effect, because mirrored walls tend to provide a feeling of spaciousness to a room while also enhancing the normal effects of window and artificial lighting. The invention disclosed in my said prior patent was intended to permit both the fabrication of the mirror panels and the installation thereof on a wall to be greatly simplified. To this end, it was proposed to assemble relatively thin mirrors panels with cardboard or fiberboard backing sheets, to encase the entire peripheral edge region of each combination of mirror panel and backing sheet with a suitable metallic channel-shaped frame, and to weld a bar to the rear face of the frame at two edges of the combination panel. The bar was sufficiently long to extend somewhat beyond the panel edges and was provided in those regions with holes adapted to accommodate screws or like fasteners to enable the bar and therewith the frame and panel combination to be affixed, i.e. screwed or bolted, to the underlying wall surface.

It is the primary object of the present invention to provide a new and improved mirrored or other type of decorative wall system which is still more simple, easy and inexpensive to fabricate and install than the one disclosed in my aforesaid patent.

Generally speaking, the objectives of the present invention are achieved by a modular decorative wall system which in the most preferred embodiment comprises the following elements and features:

(a) At least one wall surface-forming panel structure is provided, such structure including (i) a decorative panel having front and rear surfaces and (ii) a backing panel of rigid expanded polymeric material and also having front and rear surfaces. The backing panel is adhesively bonded at its front surface to the rear surface of the decorative panel and is of larger dimensions than the latter so as to have a peripheral marginal region extending beyond at least two opposite side edges of the decorative panel.

(b) At least two tacks are provided for attaching each wall surface-forming panel structure to a wall structure. Each such tack includes (i) a broad flat head having front and rear surfaces and adapted to be securely affixed to the wall structure with the rear surface of the head directed toward the wall structure, (ii) a sharp rigid prong extending frontwardly from the front surface of the head of the tack, the length of which prong is greater than the thickness of the backing panel, and (iii) a locking member having front and rear surfaces and adapted to be fitted onto and tightly retained on the prong, each two tacks, when installed on the wall structure so as to dispose the respective prongs at a spacing from each other which is somewhat greater than the side-to-side dimension of the decorative panel but somewhat less than the corresponding side-to-side dimension of the backing panel, being adapted to penetrate through the marginal regions of the backing panel when the latter is pressed thereagainst and to receive the associated locking members on the portions of the prongs projecting beyond the front surface of the backing panel, thereby to secure the wall surface-forming structure to the tacks and there-through to the wall structure.

In such a system, of course, it will normally be deemed advisable to cover and hide the initially exposed marginal regions of the backing panel of each wall surface-forming panel structure and the tracks securing the same in place. To this end, the system of the present invention further comprises the following elements and features.

(c) At least two decorative strips are provided each of which is of sufficient width to be able to overlie and hide the respective marginal regions of the backing panel and the associated tracks.

(d) Means are provided for securing each of the decorative strips to respective side edge regions of the decorative panel.

One of the advantages of the system of the present invention is that the decorative wall panel structures can be affixed to or "hung" on the wall very easily even by relatively unskilled "do-it-yourselfers" since, apart from requiring a positioning of the tacks on the wall, the procedure entails nothing more than simply pushing the panel structures against the wall so as to have the prongs of the respective sets of premounted tacks penetrate through the marginal regions of the various backing panels, with the locking members then being pushed onto the projecting portions of the prongs.

The foregoing and other objects, characteristics and advantages of the present invention will be more clearly understood from the following detailed description thereof when read in conjunction with the accompanying drawings, in which:

FIG. 3 is a sectional view of only the panel structure, taken along the line III—III in FIG. 2;

FIG. 4 is a perspective illustration of one type of tack which can be used as a part of the means for mounting a panel structure on a wall;

FIG. 5 is a sectional view taken along the line V—V in FIG. 4;

FIG. 6 is a perspective illustration of another type of tack which can be used in mounting a panel structure on a wall;

FIG. 7 is a sectional view taken along the line VII—VII in FIG. 6;

FIG. 8 is a plan view of a split-crown washer which can be used to lock a mounted panel structure to the tacks supporting the same;

FIG. 9 is a sectional view taken along the line IX—IX in FIG. 8;

FIG. 10 is a front elevational view of the wall surface-forming panel structure of FIG. 2 shown as mounted on a wall of the room shown in FIG. 1;

FIG. 11 is a sectional view taken along the line XI—XI in FIG. 10;

FIG. 12 is a fragmentary front elevational view of the wall of the room shown in FIG. 1 and illustrates in greater detail the juncture between two adjacent wall surface-forming panel structures and the associated overlying decorative finishing strip;

FIG. 13 is a sectional view taken along the line XIII—XIII in FIG. 12;

FIG. 14 is a fragmentary sectional view similar to FIG. 11 and illustrates a somewhat modified arrangement of the panel system in a room the height of which is somewhat greater than the length of the decorative panels;

FIG. 14A is a fragmentary front elevational view of the panel system shown in FIG. 14;

FIG. 15 is a front elevational view of a decorative panel system according to a further modified embodiment of the invention; and FIG. 16 is a sectional view taken along the line XVI—XVI in FIG. 15.

Figure 1:
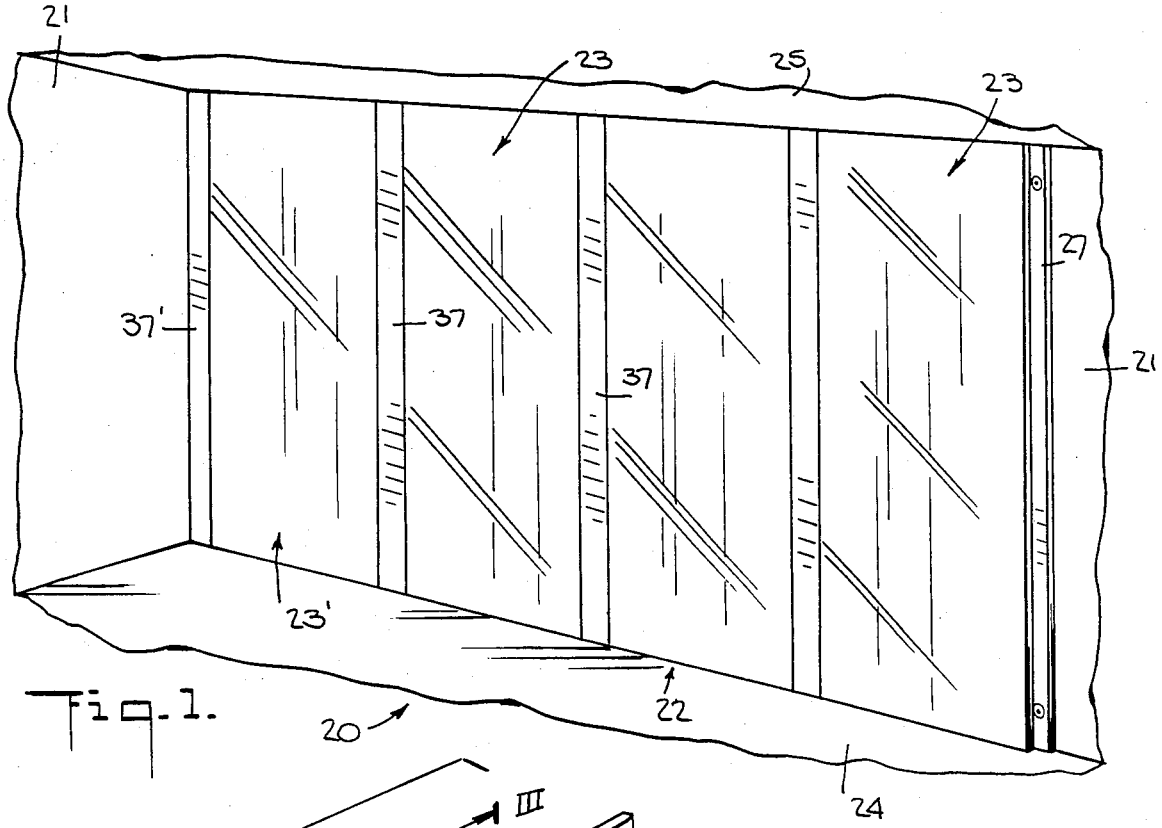
FIG. 1 is a fragmentary perspective illustration of a wall of a room covered by decorative mirrored wall system according to the present invention.

Referring now to the drawings in greater detail, there is shown in FIG. 1 a portion of a room 20 one wall 21 of which is covered by a system 22 of decorative wall paneling including a plurality of decorative wall surface-forming panel structures 23 all of which extend fully from the floor 24 to the ceiling 25 of the room. As shown in FIGS. 2, 3 and 10–13, each panel structure 23 includes a decorative panel 26 having front and rear surfaces 26*a* and 26*b*, and a backing panel 27 having front and rear surfaces 27*a* and 27*b*, with the backing panel being adhesively securely bonded at its front surface to the rear surface of the decorative panel by a layer of high strength glue or adhesive. In the illustrated form of the invention, the decorative panel is a thin sheet of mirror glass, and the backing panel is a relatively thicker sheet made of a rigid expanded polymeric material such as expanded polystyrene. The glue or adhesive can be any known material of this type, preferably one capable of setting or vulcanizing at room temperature, that is compatible with the two materials involved and that is capable of providing, when set, a bond of sufficent strength to ensure retention of the decorative panel on the backing panel when the latter is supported from a wall or like structure.

Figure 2:
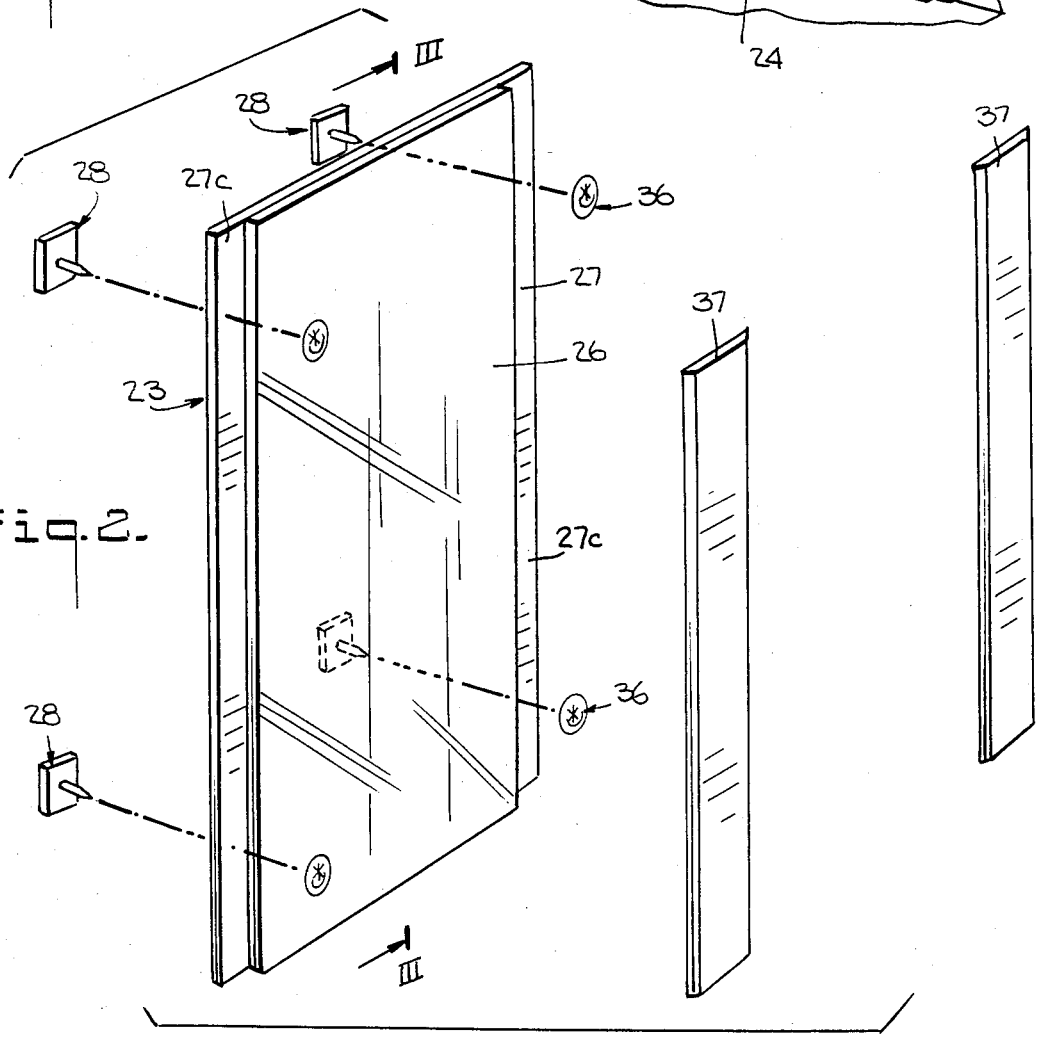
FIG. 2 is an exploded perspective illustration of one component of the wall system shown in FIG. 1, including a wall surface-forming panel structure, an associated set of decorative finishing strips and a set of two pairs of tacks for affixing the panel structure to a wall.

To enable the panel structures 23 to be mounted on a wall, each backing panel 27 is larger in size than its associated decorative panel 26, which in the case of the system 22 shown in FIG. 1 means by an amount sufficient to provide the backing panel on the two opposite longer sides of the decorative panel with respective exposed peripheral marginal regions 27*c* (see FIGS. 2 and 10). It should be noted, at this point, that in the ordinary procedures of fabricating the panel structures 23, each sheet of expanded polystyrene or like material which is to constitute the backing panel would in fact initially be sufficiently larger than the associated decorative panel as to have marginal regions exposed on all four sides of the decorative panel. For an installation in which the length of the decorative panel is equal to the height of the wall being decorated, the excess backing sheet regions at the shorter edges of the decorative panel are then simply trimmed off, leaving only the exposed marginal regions 27*c*.

As will be readily apparent from FIGS. 2, 10 and 11, the exposed marginal regions 27*c* of the backing panel component 27 of each panel structure 23 are provided for the purpose of enabling the respective panel structures to be mounted or "hung" on the wall. To this end, it is necessary for the installer first to affix a set of metallic tacks to the wall for each decorative panel structure to be hung, each such tack including basically a head to be affixed to the wall and a prong extending from the head and away from the wall when the head is affixed thereto. The length of the prong is greater than the thickness of the backing panel, so that when a marginal region of the backing panel is pressed against the prong it will be penetrated by the prong to a degree sufficient to have a portion of the prong projecting beyond the front face of the backing panel when the rear face of the latter is substantially in engagement with the front face of the head of the tack. Lastly, a locking member is provided for each tack, which can be fitted onto and retained firmly on the projecting portion of the prong so as to secure the backing panel to the tack and through the latter to the wall.

The tacks may, of course, have a variety of forms. Merely by way of example, in accordance with one variant of the present invention, the structure of such tacks may be that shown in FIGS. 2, 4 and 5, with each such tack, designated 28, including a broad flat head 29 having front and rear surfaces 29*a* and 29*b*, a sharp rigid prong 30 secured to the head 29 and extending frontwardly of the front surface 29*a* of the head, and a layer 31 of high-strength adhesive covering the rear surface 29*b* of the head. The adhesive layer, which is the means for affixing the head of the tack to the wall, is, prior to the use and installation of the tack covered by a conventional anti-stick sheet of synthetic plastic material which is peeled off when the tack is to be affixed to a wall.

In an alternative variant of the present invention, the structure of the tacks may be that shown in FIGS. 6 and 7, with each such tack, designated 32, including a broad flat head 33 having front and rear surfaces 33*a* and 33*b*, and a sharp rigid prong 34 secured to the head and extending frontwardly of the front surface of the head. Here, however, in lieu of a layer of adhesive, the head 33 of each tack 32 throughout the expanse thereof around the location of the prong 34 is formed with a plurality of apertures or holes 35 (twenty such holes are shown in FIG. 6, but obviously the number is not critical), and a supply of suitable fasteners (not shown) is provided for each tack, e.g. nails or screws which can be driven into the wall through the holes 35 to affix the tack to the wall.

Although various types of locking members may be used in conjunction with the tacks, the structure of the locking member (see FIGS. 8 and 9) which is currently preferred is that of a lock-washer, designated 36, having the form of a generally planar disc with front and rear surfaces 36*a* and 36*b* in its flat outer peripheral region 36*c* and a medial slightly domed crown region 36*d* which is provided with a central hole or aperture 36*e* and a plurality of radial slits 36*f*. The diameter of the hole 36*e* is somewhat smaller than the outer diameter of the prong 30 or 34. It will be understood, therefore, that when the lock-washer 36 is pressed and forced onto the portion of a prong projecting beyond the front surface of the marginal region of a backing panel sufficiently to bring the rear surface of the washer into engagement with the front surface of the backing panel, which is rendered possible by the deflectability of the sectoral portions of crown region 36*d*, the backing panel will be effectively locked to the tack because any return movement of the lock-washer (absent the application of a high degree of leverage) is effectively inhibited by the wedging action of the domed crown sectors which ensures a secure frictional retention of the lock-washer on the prong.

The method of installation of the panel structures 23 on the wall 21 of the room 20 is as follows. To start, the excess top and bottom marginal regions of the backing panels 27 are trimmed off substantially flush with the top and bottom edges of the decorative panels 26 of the various panel structures 23, and the requisite sets of tacks 28 (or 32) are affixed to the wall, with each set of tacks so positioned on the wall that the prongs of any two horizontally paired tacks for a given panel structure are spaced from each other by a distance somewhat greater than the side-to-side dimension of the respective decorative panel 26 but somewhat less than the corresponding side-to-side dimension of its associated backing panel 27 (see FIG. 10). It might be noted, in this regard, that while the use of four tacks per decorative panel structure, as shown in FIGS. 2 and 10, has been found to be adequate for mounting panel structures including relatively thin mirror panels such as are disclosed in my aforesaid patent, the actual number of tacks for use in any given installation may vary, depending on such factors as the weight of the paneling, the nature of the underlying wall structure, etc. Thus, in the case of a relatively heavy panel structure, e.g. where the decorative panel 26 is a sheet of marble, or perhaps in the case of a panel structure which is longer than usual, e.g. ten or twelve feet, the use of a greater number of tacks per panel structure, for example six or even more, might well be indicated and prudent. On the other hand, in the case of a relatively light or short panel structure, the use of fewer than four tacks might well be deemed sufficient. As a practical matter, of course, four tacks disposed adjacent the respective corners of a panel structure represent an optimum arrangement of fasteners which will ensure that the panel structure is rendered immovable and is stably secured in place at both its opposite ends.

Insofar as the affixation of the tacks to the wall is concerned, it will also be understood that precise positioning of the heads of the tacks of each set and alignment of their prongs both horizontally and vertically is not an absolute essential. It is believed advisable, however, for purposes of stability and proper load distribution, that each tack on one side of a panel structure should be paired with a tack on the other side.

Once the tacks have been properly affixed to the wall, the panel structures 23 are "hung" thereon, as previously mentioned, by positioning each panel structure in front of a respective set of tacks and simply pushing it back against the wall, thereby to cause the prongs of those tacks to penetrate through the marginal regions of the backing panel. When the panel structure is firmly in position, with the rear surface of its backing panel in the marginal regions thereof up against the front surfaces of the heads of the underlying tacks, the associated locking members 36 are pushed onto the portions of the prongs projecting beyond the front surfaces of the marginal regions of the backing panel until the rear surfaces of the locking members engage the front surfaces of the marginal regions of the backing panel.

It will be understood, in this regard, that an installer of a wall system according to the present invention, especially one who is not a highly skilled workman, may be well advised to perform the various phases of the job in repeated cycles of operation, each including the affixation of a set of tacks to the wall, the mounting of a properly trimmed panel structure on those tacks, and the affixation of the respective lock-washers or other locking members to the tacks. Proceeding in this way will tend to minimize the likelihood of errors being made in the hanging of the panel structures. It will be apparent, however, that an installer may instead first affix all the requisite sets of tacks to the entire expanse of the wall structure and then mount all the panel structures one after the other on the respective sets of tacks.

After all the panel structures have been properly mounted on the wall, with the proximate edges of marginal backing panel regions 27*c* abutting against each other (although this is not absolutely essential), the wall system is finished off by affixing to the decorative panels 26, preferably adhesively, respective decorative finishing strips 37, made of the same material, e. g. glass mirrors in the illustrated embodiment, as the panels 26, with each finishing strip being sufficiently wide to extend fully across and hide the respective underlying exposed marginal region of a backing sheet and the associated tacks. Thus, as shown in FIGS. 12 and 13, in the region of juncture between two adjacent panel structures 23, the finishing strip 37, apart from being of the same length as the panels themselves, must be sufficiently wide to overlie not only both of the proximate exposed marginal backing panel regions 27*c* but also respective limited marginal regions 26' of the two decorative panels 26, with the strip 37 being affixed to those regions of the decorative panels by means of layers 38 of a suitable adhesive (possibly in the form of an appropriate strip of double-faced adhesive tape). On the other hand, in the case an end panel structure, such as the one designated 23' in FIG. 1, which is located at an end of a wall in a corner of a room, the decorative strip, designated 37' in FIG. 1, need only be half as wide. For purposes of stability and to inhibit inadvertent dislodgement of the strip 37', however, it is deemed advisable for the edge of this strip that abuts the intersecting wall, designated 21' in FIG. 1, to be adhesively bonded to the latter or, alternatively, for the strip to be backed up by and preferably also adhesively bonded to one or more shims or spacers (not shown) affixed to the front surface of the underlying marginal region of the backing panel or to the wall 21'.

Somewhat modified arrangements of the decorative wall system according to the present invention are shown in FIGS. 14–16 merely by way of example. Thus, as shown in FIGS. 14 and 14A, if the height of the ceiling 25 above the floor (not shown) of the room is somewhat greater than the length of the decorative panels 26, the installer will, as before, first trim off the bottom marginal regions of the various backing panels 27 but will leave the top marginal regions 27*d* untouched and projecting beyond the top end edges of the decorative panels 26. Of course, if the widths of the marginal regions 27*d* are greater than the available space between the ceiling and the top edges of the decorative panels when resting on the floor, the installer will also first trim off so much of the top marginal regions of the backing panels as is necessary to enable these to be fully accommodated between the floor and the ceiling. The panel structures 23 are then hung on the wall-mounted tacks 28 (or 32) as so far described in connection with FIGS. 1–13.

Thereafter, but prior to the application of the vertical finishing strips 37, mirror overlay strips 39 each as wide as the space above the panels 26 and each as long as the width of a panel 26, are inserted between the ceiling 25 and the top edges of the decorative panels 26. The overlay strips 39 can be either adhesively bonded along their opposite longitudinal edges to the ceiling and the top edges of the decorative panels or, if they are of the same thickness as the decorative panels, can be adhesively bonded directly to the front surface of the top marginal regions 27*d* of the backing panels or, if they are thinner than the decorative panels, can be adhesively bonded to suitable shims or spacers (not shown) interposed between the front surfaces of the top marginal regions 27*d* of the backing panels and the rear surfaces of the overlay strips 39.

Again merely by way of example, where the height of the ceiling 25 above the floor 24 of a room is considerably greater than even the lengths of the untrimmed backing panels 27, as shown in FIGS. 15 and 16, or if for any reason a wall system of laterally abutting decorative panels is desired, the decorative panel structures 23 could be installed in a slightly different fashion than as so far described. In such a situation, the installer first trims off the opposite side marginal regions of the backing panels 27 but leaves the top and bottom marginal regions 27*d* untouched. Correspondingly, of course, the sets of tacks 28 (or 32) are affixed to the wall 21 at such locations as to dispose the vertically spaced prongs at a spacing from one another somewhat greater than the lengths (i.e. the top to bottom dimensions) of the decorative panels but somewhat less than the lengths of the backing panels. The exposed marginal regions 27*d* of the backing panels at both the top and bottom edges of the decorative panels and their associated mounting tacks are then covered by corresponding decorative finishing strips 40, each at one edge region thereof being adhesively bonded at 41 to a respective top or bottom marginal region, designated 26" in FIG. 16, of a decorative panel and at the opposite edge region thereof being adhesively bonded to one or more suitable shims or spacers 42 or 43 extending from the wall 21 under the ceiling 25 and over the floor 24, respectively.

Still other arrangements of the wall system according to the present invention for use in different situations will readily suggest themselves to those skilled in the art. Thus, merely by way of example, under some circumstances, as where it is concluded by the installer that multi-point fastening of the panel structures 23 can be dispensed with, it may be possible to use a panel structure in which the backing panel is left with only one marginal region therof exending beyond one edge of an associated decorative panel, and to use only one tack 28 (or 32) for securing the panel structure to the wall. This can best be visualized from FIGS. 15 and 16 by imagining the bottom marginal region 27*d* as having ben omitted. In such a case, the single tack would, of course, be affixed to the wall so as to dispose the prong in a location corresponding to the ultimate location of the retained marginal region of the backing panel, preferably the ultimate location of the midpoint of that marginal region. On the other hand, in the system of FIGS. 15 and 16 modified as just described to utilize a panel structure having only one projecting marginal region of the backing panel, if structural conditions warrant a 2-point fastening utilizing only two tacks, the prongs of which both penetrate through the same single marginal region, may be found to be satisfactory.

For esthetic reasons, the finishing strips 37 and 40 have been illustrated as being beveled along their longitudinal edges, substantially as disclosed in my aforesaid earlier U.S. Pat. No. 4,452,022. It will be apparent, however, that finishing strips devoid of bevels, in the same fashion as the overlay strips 39, could be used as well.

It will be understood that the foregoing description of preferred embodiments of the decorative wall system according to the present invention is for purposes of illustration only and that the herein disclosed structural features and relationships are susceptible to a number of changes and modifications none of which entails any departure from the spirit and scope of the present invention as defined by the hereto appended claims.

What is claimed is:

1. A modular decorative wall system, comprising:

(a) at least one wall surface-forming panel structure including (i) a decorative panel having front and rear surfaces, and (ii) a backing panel of rigid expanded polymeric material and having front and rear surfaces, said backing panel being adhesively bonded at said front surface thereof to said rear surface of said decorative panel and being of larger dimensions than the latter so as to have a peripheral marginal region extending beyond, at least one side edge of said decorative panel; and (b) at least one tack for attaching said wall surface-forming panel structure to a wall structure, each tack including (i) a broad flat head with front and rear surfaces and adapted to be securely affixed to said wall structure with said rear surface of said head directed toward said wall structure, (ii) a sharp rigid prong extending frontwardly from said front surface of said head, the length of said prong being greater than the thickness of said backing panel, and (iii) a locking member having front and rear surfaces and adapted to be fitted onto and tightly retained on said prong, each tack, when installed on said wall structure so as to dispose the respective prong in a location corresponding to the ultimate location of said marginal region of said backing panel, being adapted to penetrate through said marginal region of said backing panel when the latter is pressed thereagainst and to receive the associated locking member on the portion of said prong projecting beyond said front surface of said backing panel, thereby to secure said wall surface-forming panel structure to said tack and therethrough to said wall structure.

2. A modular decorative wall system as claimed in claim 1, wherein said locking member is a generally planar disc having a medial opening therein and is adapted to be frictionally driven onto and retained on the portion of said prong projecting beyond said front surface of said backing panel, thereby to secure said wall surface-forming panel structure to the associated tack.

3. A modular decorative wall system as claimed in claim 1, wherein for affixing said head of said tack to said wall structure a layer of pressure-sensitive adhesive is coated onto said rear surface of said head.

4. A modular decorative wall system as claimed in claim 3, wherein said locking member is a generally planar disc having a medial opening therein and is adapted to be frictionally driven onto and retained on the portion of said prong projecting beyond said front surface of said backing panel, thereby to secure said wall surface-forming panel structure to the associated tack.

5. A modular decorative wall system as claimed in claim 1, wherein for affixing said head of said tack to said wall structure each head is apertured at a plurality of locations throughout its expanse around the associated prong, and fasteners adapted to be driven into said wall structure through at least some of the apertures in said head are provided.

6. A modular decorative wall system as claimed in claim 5, wherein said locking member is a generally planar disc having a medial opening therein and is adapted to be frictionally driven onto and retained on the portion of a respective prong projecting beyond said front surface of said backing panel, thereby to secure said wall surface-forming panel structure to the associated tack.

7. A modular decorative wall system as claimed in claim 1, wherein said decorative panel is a mirror panel.

8. A modular decorative wall system as claimed in claim 1, wherein said backing panel is made of rigid expanded polystyrene.

9. A modular decorative wall system as claimed in claim 8, wherein said decorative panel is a mirror panel.

10. A modular decorative wall system as claimed in claim 1, wherein two tacks and locking members are provided for coaction with the same marginal region of said backing panel.

11. A modular decorative wall system, comprising:

(a) at least one wall surface-forming panel structure including
  (i) a decorative panel having front and rear surfaces, and
  (ii) a backing panel of rigid expanded polymeric material and having front and rear surfaces,
  said backing panel being adhesively bonded at said front surface thereof to said rear surface of said decorative panel and being of larger dimensions than the latter so as to have a peripheral marginal region extending beyond at least two opposite side edges of said decorative panel; and (b) at least two tacks for attaching said wall surface-forming panel structure to a wall structure, each tack including
  (i) a broad flat head with front and rear surfaces and adapted to be securely affixed to said wall structure with said rear surface of said head directed toward said wall structure,
  (ii) a sharp rigid prong extending frontwardly from said front surface of said head, the length of said prong being greater than the thickness of said backing panel, and
  (iii) a locking member having front and rear surfaces and adapted to be fitted onto and tightly retained on said prong,
  each two tacks, when installed on said wall structure so as to dispose the respective prongs at a spacing from each other which is somewhat greater than the side-to-side dimension of said decorative panel but somewhat less than the corresponding side-to-side dimension of said backing panel, being adapted to penetrate through said marginal regions of said backing panel when the latter is pressed thereagainst and to receive the associated locking members on the portions of said prongs projecting beyond said front surface of said backing panel, thereby to secure said wall surface-forming panel structure to said tacks and therethrough to said wall structure.

12. A modular decorative wall system as claimed in claim 11, wherein each locking member is a generally planar disc having a medial opening therein and is adapted to be frictionally driven onto and retained on the portion of a respective prong projecting beyond said front surface of said backing panel, thereby to secure said wall surface-forming panel structure to the associated tacks.

13. A modular decorative wall system as claimed in claim 11, wherein for affixing said heads of said tacks to said wall structure a layer of pressure-sensitive adhesive is coated onto said rear surface of each head.

14. A modular decorative wall system as claimed in claim 13, wherein each locking member is a generally planar disc having a medial opening therein and is adapted to be frictionally driven onto and retained on the portion of a respective prong projecting beyond said front surface of said backing panel, thereby to secure said wall surface-forming panel structure to the associated tacks.

15. A modular decorative wall system as claimed in claim 11, wherein for affixing said heads of said tacks to said wall structure each head is apertured at a plurality of locations throughout its expanse around the associated prong, and fasteners adapted to be driven into said wall structure through at least some of the apertures in said heads are provided.

16. A modular decorative wall system as claimed in claim 15, wherein each locking member is a generally planar disc having a medial opening therein and is adapted to be frictionally driven onto and retained on the portion of a respective prong projecting beyond said front surface of said backing panel, thereby to secure said wall surface-forming panel structure to the associated tacks.

17. A modular decorative wall system as claimed in claim 11, wherein said decorative panel is a mirror panel.

18. A modular decorative wall system as claimed in claim 11, wherein said backing panel is made of rigid expanded polystyrene.

19. A modular decorative wall system as claimed in claim 18, wherein said decorative panel is a mirror panel.

20. A modular decorative wall system as claimed in claim 1, further comprising:

(c) at least one decorative strip of sufficient width to be able to overlie and hide the respective marginal region of said backing panel and the associated tack; and (d) means for securing said decorative strip to a respective side edge region of said decorative panel.

21. A modular decorative wall system as claimed in claim 11, further comprising:

(c) at least two decorative strips of sufficient width to be able to overlie and hide the respective marginal regions of said backing panel and the associated tacks; and (d) means for securing said decorative strips to respective side edge regions of said decorative panel.

* * * * *